US008678691B2

(12) United States Patent
Kiritake et al.

(10) Patent No.: US 8,678,691 B2
(45) Date of Patent: Mar. 25, 2014

(54) WRITING IMPLEMENT

(75) Inventors: Masayoshi Kiritake, Yokohama (JP); Nobuaki Shimane, Tokyo (JP); Kengo Nagaoka, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 812 days.

(21) Appl. No.: 12/734,611

(22) PCT Filed: Nov. 12, 2008

(86) PCT No.: PCT/JP2008/070554

§ 371 (c)(1),
(2), (4) Date: May 12, 2010

(87) PCT Pub. No.: WO2009/063888

PCT Pub. Date: May 22, 2009

(65) Prior Publication Data

US 2010/0284723 A1 Nov. 11, 2010

(30) Foreign Application Priority Data

Nov. 14, 2007 (JP) ..... 2007-295464

(51) Int. Cl.
*A46B 5/02* (2006.01)
*B43K 5/00* (2006.01)
*B43K 7/00* (2006.01)

(52) U.S. Cl.
USPC ..... 401/6; 401/20; 401/209; 401/221

(58) Field of Classification Search
USPC ..... 401/6
See application file for complete search history.

(56) References Cited

U.S. PATENT DOCUMENTS

| | | | | |
|---|---|---|---|---|
| 4,991,985 | A * | 2/1991 | Laipply | 401/6 |
| 6,648,535 | B2 * | 11/2003 | Ferrara, Jr. | 401/6 |
| 7,153,052 | B2 * | 12/2006 | Nakayama et al. | 401/6 |
| 7,789,580 | B2 * | 9/2010 | Cheng | 401/6 |
| 2003/0123917 | A1 * | 7/2003 | Willat et al. | 401/6 |
| 2007/0020018 | A1 * | 1/2007 | Kobayashi et al. | 401/6 |
| 2010/0074669 | A1 * | 3/2010 | Liu | 401/6 |

FOREIGN PATENT DOCUMENTS

| | | | |
|---|---|---|---|
| JP | 3050606 | U | 5/1998 |
| JP | 10-236070 | A | 9/1998 |
| JP | 10-297161 | A | 11/1998 |
| JP | 2000-355185 | A | 12/2000 |
| JP | 2004-066560 | A | 3/2004 |
| JP | 2004-291612 | A | 10/2004 |

* cited by examiner

*Primary Examiner* — David J. Walczak
*Assistant Examiner* — Joshua Wiljanen
(74) *Attorney, Agent, or Firm* — Kubovcik & Kubovcik

(57) ABSTRACT

A writing implement. A tubular outer shell (11) is provided outside a grip member (10), an inner shell (12) made of a soft material is provided entirely inside the outer shell (11), and the inner shell (12) is covered with the moderately hard outer shell (11). Thus, while the inner shell (12) inside can allow the user to feel the fit, the outer shell (11) outside prevents the inner shell (12) from getting damaged or worn even if the inner shell (12) is soft, so as to fully secure durability of the grip member (10). Since a thin part (11A) of the outer shell (11) is sufficiently thin on a swell (13), the excellent fit can be given to the user even if the outer shell (11) is formed of a hard elastic material to fully secure the durability of the grip member (10).

4 Claims, 5 Drawing Sheets

WRITING IMPLEMENT

This application is a 371 of international application PCT/JP2008/070554, filed Nov. 12, 2008, which claims priority based on Japanese patent application No. 2007-295464 filed Nov. 14, 2007, which is incorporated herein by reference.

TECHNICAL FIELD

The present invention relates to a writing implement comprising a cylinder-shaped shaft tube, and a cylinder-shaped grip member made of a soft elastic material fitted at a position on the shaft tube where a user can easily grip.

BACKGROUND ART

Conventionally, such a writing implement has been utilized that a soft grip member is fitted at a vicinity of a tip end of its shaft tube gripped by a user in order not to slip the grip and not to pain the user's fingers while the user writes for a long time.

More specifically, the shaft tube formed in a cylindrical shape of the writing implement includes a reduced-diameter part formed by reducing the diameter of the shaft tube in the vicinity of its tip end. Further, a grip member formed in a cylindrical shape with an inner diameter corresponding to the reduced-diameter part is fitted on the diameter-reduced part of the shaft tube.

As a material for such a grip member, a soft elastic material like a rubber such as EPDM (ethylene-propylene-diene rubber) and NBR (acrylonitrile-butadiene rubber), or thermoplastic elastomer is generally used.

Moreover, silicon rubber that gives a user gel-like feel such as gel of fluent material can also be adopted as the material for the grip member.

Here, when the grip member formed of an elastic material is deformed by a griping force, it is forced to return to its original shape due to its elastic force. Therefore, the user feels bounce and does not have an excellent fit.

On the other hand, when the silicon rubber having a gel-like feeling adopted as the material for the grip member is deformed by external force, it is elastically deformed in such a plastically deforming manner that the silicon rubber gradually returns back to its original shape. Therefore, bounce due to elastic deformation hardly occurs when the user grips the grip member, and the grip member deforms in conformity with a shape of a finger tip of the user due to griping force of the user, whereby giving the user an excellent fit (e.g. Patent document 1).

Patent document 1:JP 2004-291612 A

SUMMARY OF INVENTION

However, since some users think that they would like to feel some bounce in the grip, there is such a demand that a user is allowed to feel moderate bounce without damaging fitting feeling.

Here, a user can hardly feel bounce in a grip member made of the silicon rubber with gel-like feeling, while the fitting feeling is damaged in a grip member obtained by simply shaping an elastic material, so that the above demand cannot be realized.

Incidentally, it is thought that the grip member is formed of a considerable soft elastic material so that a user is given moderate bounce without damaging the fitting feeling. However, when the grip member is formed of such a soft elastic material, durability of the grip member is remarkably damaged and the grip member does not work as a product, so that the above demand cannot be realized.

Therefore, respective aspects of the invention described below have been made in view of the problem contained in the above background art, and an object thereof is to provide a writing implement which is capable of giving a user both an excellent fit and a moderate bounce.

Respective aspects of the invention described below have been made in order to achieve the above object.

(First Aspect)

A first aspect of the present invention has the following feature.

That is, the first aspect of the present invention is a writing implement comprising a cylinder-shaped shaft tube, and a cylinder-shaped grip member made of a soft elastic material fitted at a position on the shaft tube where a user can easily grip, wherein the grip member integrally comprises a cylinder-shaped outer shell provided outside the grip member, and an inner shell made of a material softer than the outer shell provided inside the outer shell.

(Second Aspect)

A second aspect of the present invention is obtained by adding the following feature to the first aspect of the present invention described above.

That is, the second aspect of the present invention has such a feature that a thickness of a part of the outer shell is made thin to be a thin part, and that the inner shell is provided at least on a back side of the thin part inside the outer shell.

(Third Aspect)

A third aspect of the present invention is obtained by adding the following feature to the second aspect of the present invention described above.

That is, the third aspect of the present invention has such a feature that a swollen part swelling outward is formed on a surface of the grip member, that the thin part is formed at a part corresponding to the swollen part of the outer shell, and that the inner shell is formed inside the thin part of the outer shell corresponding to the swollen part.

(Fourth Aspect)

A fourth aspect of the present invention is obtained by adding the following feature to the third aspect of the present invention described above.

That is, the fourth aspect of the present invention has such a feature that a part of the inner shell is so formed as to face at least one end face of the grip member.

(Fifth Aspect)

A fifth aspect of the present invention is obtained by adding the following feature to the fourth aspect of the present invention described above.

That is, the fifth aspect of the present invention has such a feature that the swollen part inside which the inner shell is provided is formed in the grip member at one of three angular positions approximately trisecting a center angle to a central axis of the shaft tube, and that the swollen part inside which the inner shell is provided is not formed at the other angular positions.

The present invention thus configured achieves such effects as described below.

That is, according to the first aspect of the present invention, the cylindrical outer shell is provided outside the grip member and the inner shell made of a soft material is provided inside the outer shell. Therefore, even if the inner shell is made so soft as to give a user an excellent fit, damage or wear of the inner shell is prevented by covering the inner shell with the outer shell with moderate hardness, and durability of the grip member can be secured sufficiently. In addition, even if the outer shell is formed of a hard elastic material, softness of the inner shell is not damaged by making the thickness of the outer shell sufficiently thin. Accordingly, the durability of the grip member can be sufficiently secured, and the excellent fit can be given to the user, so that the above object can be achieved.

According to the second aspect of the present invention, the following effect can be achieved in addition to the effect obtained by the first aspect of the present invention.

That is, according to the second aspect of the present invention, as described above, the inner shell made of a soft material is provided at least on the back side of the thin part inside the outer shell. Therefore, even if the inner shell is made soft as described above, the durability of the grip member can be sufficiently secured by forming the outer shell of a moderately hard member. In addition, since the thickness of the outer shell is made thin, the thickness of the soft inner shell can be increased by an amount corresponding to the decrease of the thickness of the outer shell without increasing the thickness of the grip member. Thus, it is made possible to secure the thickness of the inner shell and the softness thereof can be exerted securely, so that both the durability of the grip member and the excellent fit can be realized.

According to the third aspect of the present invention, the following effect can be achieved in addition to the effect obtained by the second aspect of the present invention described above.

That is, according to the third aspect of the present invention, the swollen part swelling outward is provided on the surface of the grip member, the thin part is formed at a part corresponding to the swollen part in the outer shell, and the inner shell is formed within the thin part. Therefore, even if it is impossible to make the entire thickness of the grip member thick, the thickness of the soft inner shell can be increased by making the thickness of a part corresponding to the swollen part thick. Thus, it is made possible to secure the thickness of the inner shell sufficiently, and the softness of the inner shell can be exerted securely. Accordingly, both the durability of the grip member and the excellent fit of the grip member can be realized.

According to the fourth aspect of the present invention, the following effect can be achieved in addition to the effect obtained by the third aspect of the present invention described above.

That is, according to the fourth aspect of the present invention, the inner shell is formed such that a part thereof faces at least one end face of the grip member. Therefore, when the grip member is formed by molding synthetic resin in a mold, synthetic resin for forming the inner shell can be injected to a molding face for molding an end face of the grip member in the mold. Thus, even if the grip member is manufactured by a two-color injection molding method for sequentially injecting two different kinds of synthetic resins into the mold, the inner shell is not exposed on a surface of the outer shell. Accordingly, the durability of the grip member can be secured while the excellent fit is given to a user.

According to the fifth aspect of the present invention, the following effect can be achieved in addition to the effect obtained by the fourth aspect of the present invention described above.

That is, according to the fifth aspect of the present invention, the swollen part is provided at a position corresponding to one angular position of three angular positions approximately trisecting the center angle to the central axis of the shaft tube, and the swollen part is not provided in the other two angular positions. Therefore, a soft site where the inner shell is disposed is formed at one angular position of the three angular positions, while relatively hard sites mainly composed of the outer shell are formed at the other two angular positions.

Therefore, when a user grips the writing implement, the user's index finger and thumb being placed on the two hard sites and the soft site where the swollen part is formed being placed on the user's middle finger, the index finger and the thumb can hold the relatively hard sites of the grip member. Thus, the writing implement can be held securely. In addition, since the soft site of the grip member touches a part of the middle finger where a callus can easily grow and the swollen part of the grip member is easily deformed in a shape fitting the middle finger, the excellent fit can also be given to the user from this point. Then, even if the user writes for a long time, the secure grip and the excellent fit of the writing implement given to the user can suppress fatigue due to the writing to the minimum as well as giving neither slip of the grip nor pain of fingers.

BEST MODE FOR CARRYING OUT THE INVENTION

An embodiment showing a best mode for carrying out the present invention is explained below with reference to the drawings.

Figure 1:
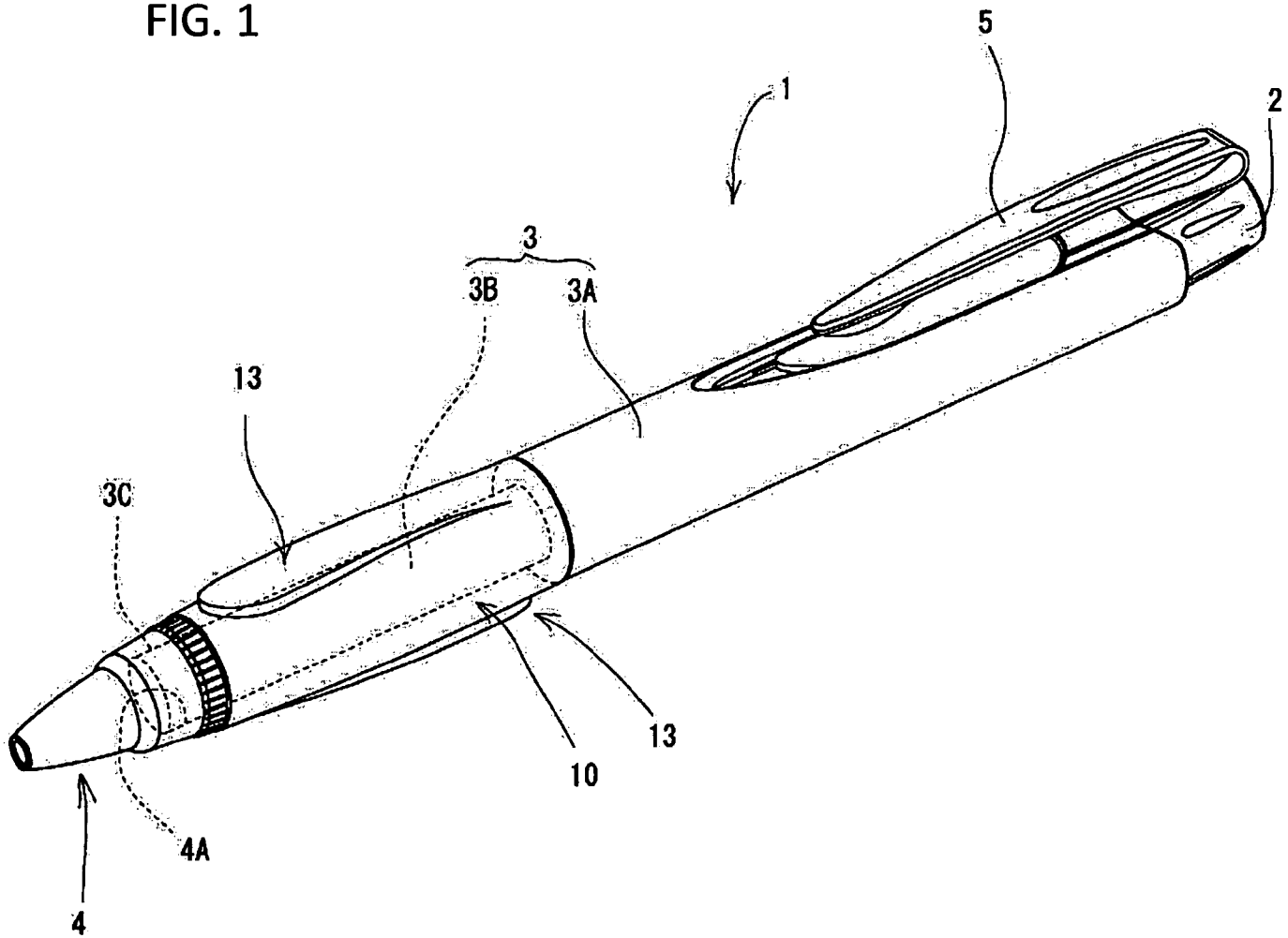
[FIG. 1] A perspective view illustrating a writing implement according to one embodiment of the present invention.

FIGS. 1 and 2 illustrate the embodiment. FIG. 1 illustrates a perspective view of a writing implement according to the embodiment, and FIG. 2 illustrates sectional views showing a grip member according to the embodiment.

As shown in FIG. 1, a writing implement 1 according to the embodiment is a retractable ballpoint pen formed such that a refill (not shown) housed therein is held movably in an axial direction of the ballpoint pen, and when a push-button 2 provided at a rear end part of the ballpoint pen is pushed, a pen tip (not shown) of the refill housed therein is pushed out from the inside of the ballpoint pen.

Such a writing implement 1 is provided, in addition to the refill and the push-button 2, with a cylindrical shaft tube 3 housing the refill therein, an approximately conical tip member 4 screwed to a tip end part positioned at one end side of the shaft tube 3, and a cylindrical grip member 10 disposed near a tip end part of the shaft tube 3 where a user can easily grip.

The shaft tube 3 includes a clip member 5 integrated at its rear end part for clipping a fabric of a pocket of user's clothes when inserted into the pocket.

A retracting mechanism (not shown) for protruding and retracting the pen tip of the refill is housed within the rear end part of the shaft tube 3. After the pen tip of the refill is pushed out by a pushing operation to the push-button 2, the retracting mechanism maintains the pushed-out state until the push-button 2 is operated in a pushing manner again. Moreover, the retracting mechanism is also provided with a function of retreating the pen tip of the refill to retract it into the shaft tube 3 when the push-button 2 is pushed in the pushed-out state.

At a tip end part of the shaft tube 3 is formed a reduced-diameter part 3B whose outer diameter is reduced to be smaller than an outer diameter of a rear shaft 3A which is a part positioned on a rear end side of the shaft tube 3. Then, the cylindrical grip member 10 made of a soft elastic material such as thermoplastic elastomer is fitted on the reduced-diameter part 3B from the tip end side of the shaft tube 3. Moreover, a tip end part 3C of the reduced-diameter part configures an external thread part obtained by forming a thread groove on an outer peripheral surface of the tip end part 3C helically.

On the other hand, a tip member 4 is opened at its bottom surface and a thread groove is helically formed on an inner peripheral surface 4A of the tip member 4, so that the inner peripheral surface 4A configures an internal thread part. Then, the tip member 4 is attached to the shaft tube 3 by screwing the inner peripheral surface 4A which is the internal thread part to the tip end part 3C which is the external thread part formed on the reduced-diameter part 3B on the side of the shaft tube 3.

The grip member 10 is provided at a position on the shaft tube 3 which a user can easily grip. As shown in FIG. 2, the grip member 10 is configured by integrally forming a cylindrical outer shell 11 provided outside the grip member 10 and an inner shell 12 provided inside the outer shell 11 and made of a material softer than the outer shell 11.

The outer shell 11 of these shells is formed of a thin part 11A whose thickness is made thin and a thick part 11B whose thickness is thick. Thereby, the outer shell 11 has such a configuration that the thin part 11A whose thickness is made thin is partially formed.

On the other hand, the inner shell 12 has such a configuration that a thick part 12A whose thickness is thick is formed corresponding to the thin part 11A of the outer shell 11 and a thin part 12B whose thickness is thin is formed corresponding to the thick part 11B of the outer shell 11. Thereby, the inner shell 12 is provided at least on a back side of the thin part 11A inside the outer shell 11.

A swollen part 13 swelling from a surface of the grip member 10 outward is formed on the surface of the grip member 10. The outer shell 11 is formed with the thin part 11A at a part corresponding to the swollen part 13.

On the other hand, the inner shell 12 has such a configuration that the thick part 12A is formed within the thin part 11A of the outer shell 11 corresponding to the swollen part 13.

Figure 2B:
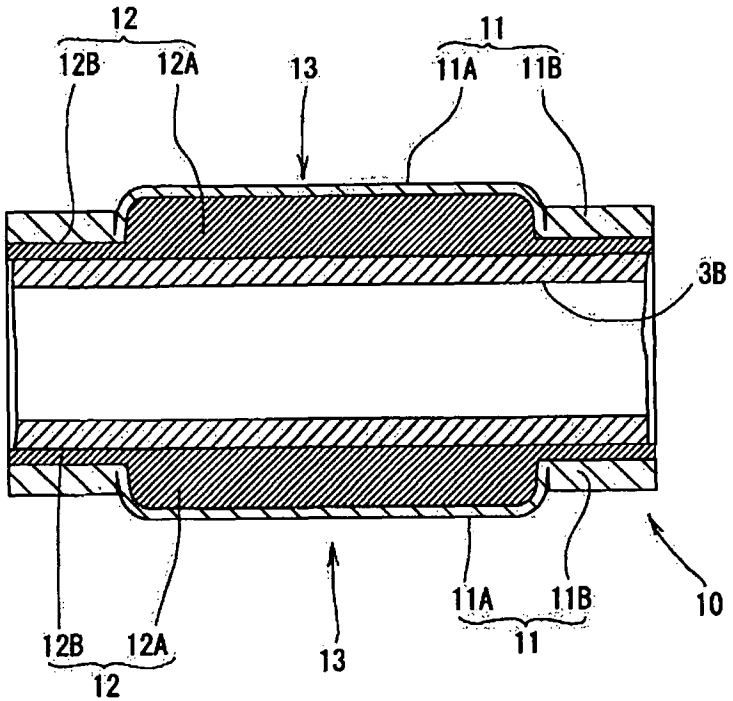
[FIG. 2] Sectional views illustrating a grip member of the writing implement according to the embodiment.

Moreover, as shown in FIG. 2(B), the inner shell 12 is formed such that both end parts thereof face corresponding end faces of the grip member 10, respectively.

At this time, a pair of swollen parts 13 disposed at angular positions approximately bisecting the center angle to the central axis of the shaft tube 3, respectively, is formed on the grip member 10.

As shown in FIG. 1, each of these swollen parts 13 is formed in a band shape extending in an axial direction of the shaft tube 3 on the surface of the grip member 10.

Figure 2A:
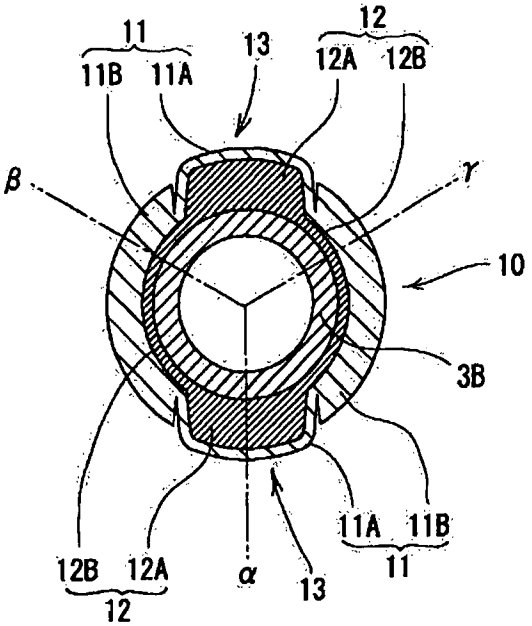

Then, as shown in FIG. 2(A), the pair of swollen parts 13 is disposed opposite to each other so as to sandwich the reduced-diameter part 3B of the shaft tube 3.

In other words, as shown in FIG. 2(A), the swollen part 13 in which the thick part 12A of the inner shell 12 is provided is formed at one angular position α of three angular positions α, β and γ approximately trisecting the central angle to the central axis of the shaft tube 3, while the swollen part 13 is not formed at the other angular positions β and γ, and the thick part 12A of the inner shell 12 is not provided within parts of the outer shell 11 at the angular positions β and γ. Thereby, a soft site in which the thick part 12A of the inner shell 12 is disposed is formed at the one angular position α of the three angular positions α, β and γ, while relatively hard sites mainly composed of the outer shell 11 are formed at the other two angular positions β and γ.

According to the embodiment as described above, the following effects can be obtained.

That is, the cylindrical outer shell 11 is provided outside the grip member 10 and the inner shell 12 made of a soft material is provided entirely inside the outer shell 11. Therefore, even if the inner shell 12 is made soft enough to give a user an excellent fit by covering the inner shell 12 with the moderately hard outer shell 11, damage or wear of the inner shell 12 can be prevented so that durability of the grip member 10 can be sufficiently secured. In addition, even if the outer shell 11 is formed of a hard elastic material, softness of the inner shell 12 is not damaged by making the thickness of the outer shell sufficiently thin. Accordingly, the durability of the grip member 10 can be secured sufficiently, and excellent fit performance is imparted to the writing implement 1 by the grip member 10, so that the excellent fit can be given to the user.

Moreover, the thick part 12A of the inner shell 12 made of a soft material is provided on the back side of the thin part 11A configuring the inside of the outer shell 11. Therefore, even if the inner shell 12 is made soft by forming the outer shell 11 using a moderately hard member, the durability of the grip member 11 can be sufficiently secured. In addition, since the outer shell 11 is formed such that the thickness of the part (the thin part 11A) within which the thick part 12A of the inner shell 12 is provided is made thin, the thickness of the soft inner shell 12 can be increased by an amount corresponding to decrease of the thickness of the outer shell 11 without considerably increasing the entire thickness of the grip member 10. Thereby, securement of the thickness of the inner shell 12 can be achieved easily, and softness of the inner shell 12 can be exerted securely. Then, also from this point, both of the durability of the grip member 10 and the excellent fit can be realized.

Furthermore, the swollen part 13 swelling outward is provided on the surface of the grip member 10, the thin part 11A is formed at the part of the outer shell 11 corresponding to the swollen part 13, and the thick part 12A of the inner shell 12 is formed within the thin part 11A. Therefore, even if it is impossible to make the thickness of the grip member 10 thick entirely, the thickness of the thick part 12A of the soft inner shell 12 can be sufficiently increased by forming the swollen part 13. Thereby, the thickness of the thick part 12A of the inner shell 12 can be sufficiently secured, and softness of the inner shell 12 can be exerted securely. Accordingly, both the durability of the grip member 10 and the excellent fit can be realized.

Moreover, the inner shell 12 is formed such that its end part faces an end face of the grip member 10. Therefore, when the grip member 10 is manufactured by molding synthetic resin in a mold, the synthetic resin for forming the inner shell 12 can be injected from a gate opened at a molding face of the mold for molding an end face of the grip member 10. Thereby, even if the grip member 10 is manufactured by a two-color injection molding method for sequentially injecting two different kinds of synthetic resins into a mold, harming the durability of the grip member 10 due to exposure of the inner shell 12 on a surface of the outer shell 11 is prevented. Accordingly, the durability of the grip member 10 can be secured while the excellent fit is provided.

Furthermore, when the swollen part 13 is provided on the grip member 10, the swollen part 13 is provided at a position corresponding to one angular position α of three angular positions α, β and γ approximately trisecting the center angle to the central axis of the shaft tube 3, while the swollen part 13 is not provided at the other two angular positions β and γ. Therefore, a soft site in which the thick part 12A of the inner shell 12 is disposed is formed at the one angular position α of the three angular positions α, β and γ, while relatively hard sites mainly composed of the outer shell 11 are formed at the other two angular positions β and γ.

Then, when a user grips the writing implement 1, if the user's index finger and thumb being placed on the two hard sites of the grip member 10, respectively, and the soft site where the swollen part 13 is formed being placed on the user's middle finger, the index finger and thumb can hold the relatively hard sites of the grip member 10. Thus, the writing implement 1 can be held securely. In addition, since the soft site of the grip member 10 touches a part of the middle finger where a callus can easily grow and the swollen part 13 of the grip member 10 is easily deformed in a shape fitting the middle finger, the excellent fit can also be given to the user from this point. Then, even if the user writes for a long time, the secure grip and the excellent fit of the writing implement 1 given to the user can suppress fatigue due to the writing to the minimum as well as giving neither slip of the grip nor pain of fingers.

Further, the present invention is not limited to the above embodiment, and it can include modification, improvement and the like made within a scope where the object of the present invention can be achieved.

Figure 3B:
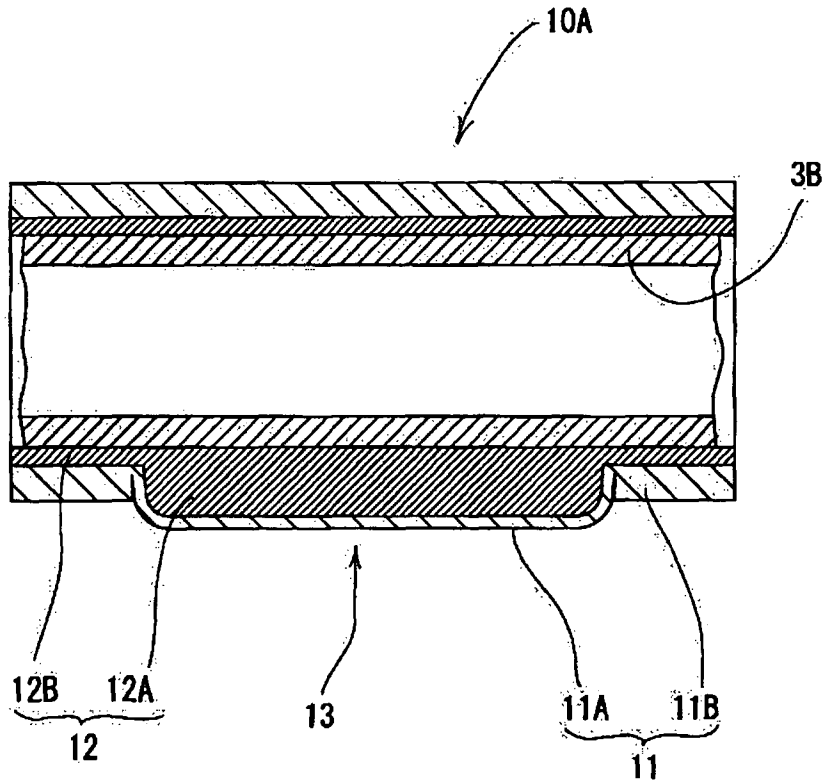
[FIG. 3] Sectional views illustrating a modified embodiment of the present invention.
Figure 3A:
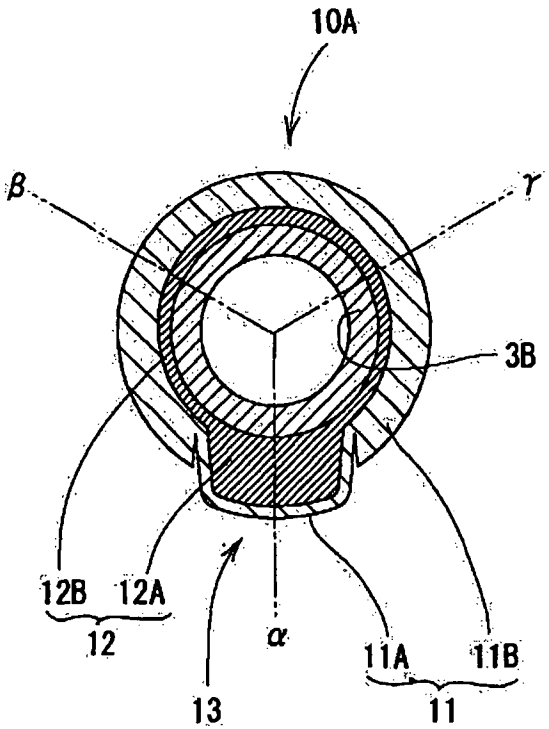

For example, the grip member is not limited to the grip member 10 where a pair of swollen parts 13 is formed such that they are disposed opposite to each other so as to sandwich the reduced-diameter part 3B of the shaft tube 3, and it may be a grip member 10A formed with only one swollen part 13, as shown in FIG. 3.

An operation and an effect similar to those in the above embodiment can also be achieved by a writing implement adopting such a grip member 10A.

Figure 4B:
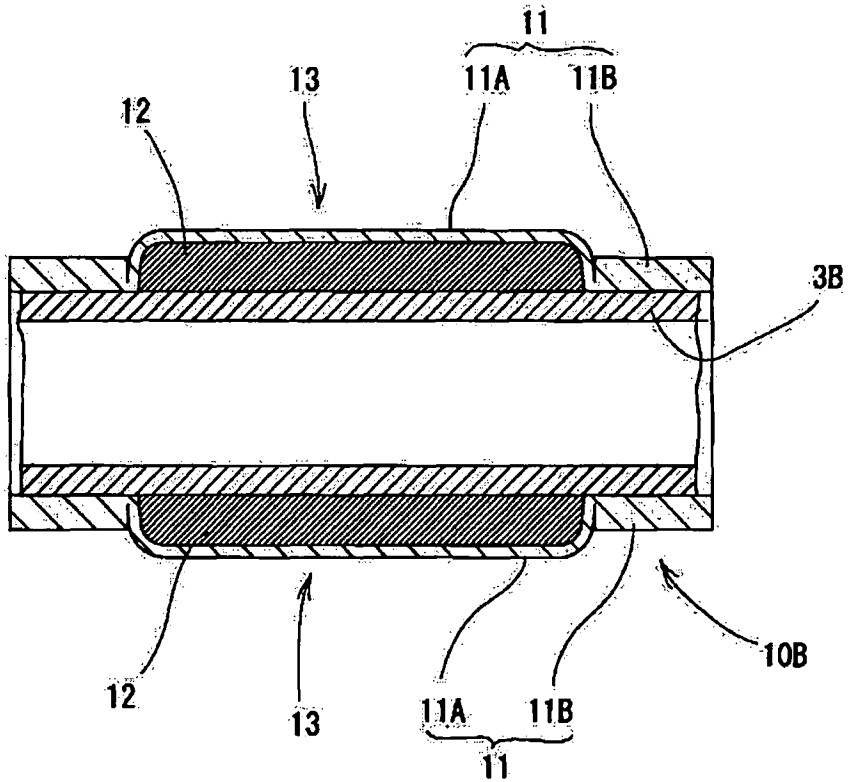
[FIG. 4] Sectional views illustrating another modified embodiment of the present invention.
Figure 4A:
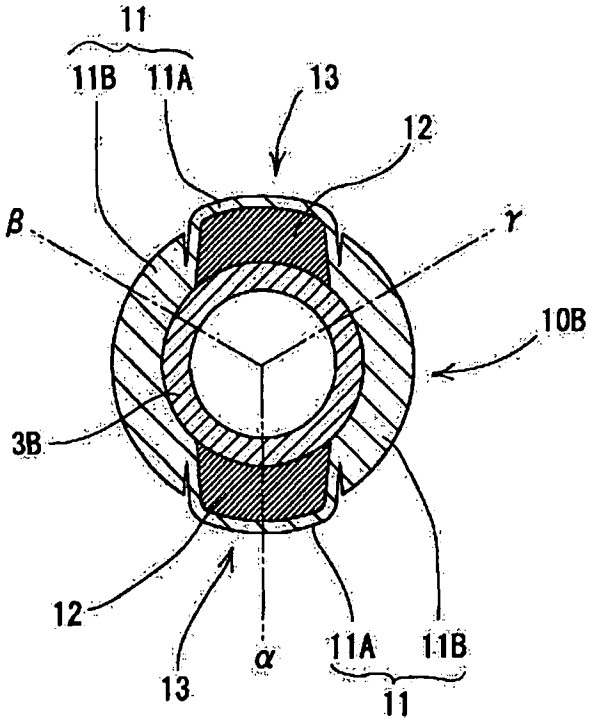
Figure 5B:
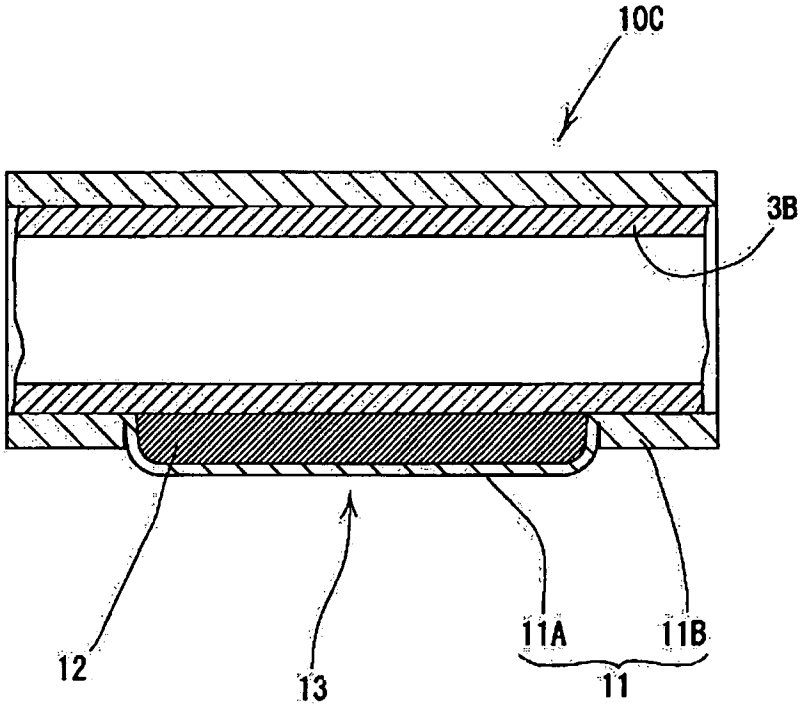
[FIG. 5] Sectional views illustrating still another embodiment of the present invention.
Figure 5A:
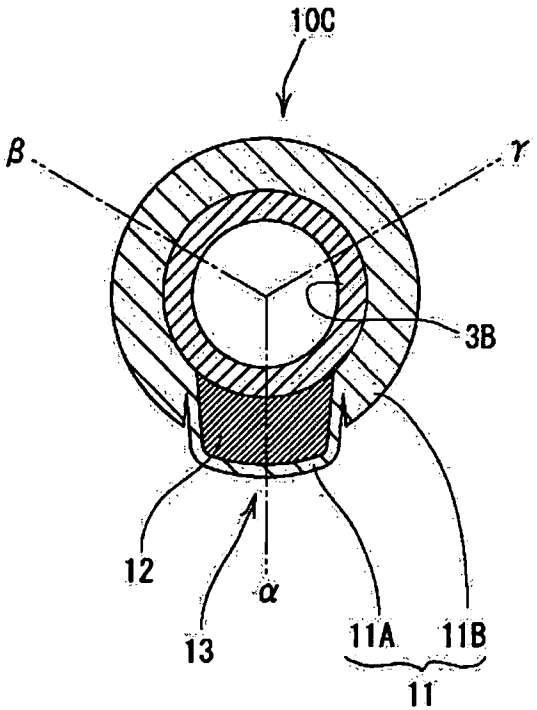

Furthermore, the grip member is not limited to the grip member 10 provided with the cylindrical inner shell 12 provided entirely inside the outer shell 11, and it may be grip members 10B and 10C provided with the inner shell 12 provided at least only on a back side of the thin part 11A within the outer shell 11, namely, provided only within the swollen part 13, as shown in FIGS. 4 and 5.

Here, as the grip member where the inner shell 12 is provided only within the swollen part 13, not only the grip member 10B including a pair of swollen parts 13 formed on both sides of the shaft tube 3 opposite to each other so as to sandwich the reduced-diameter part 3B of the shaft tube 3 as shown in FIG. 4, but also the grip member 10C formed with one swollen part 13 disposed only on one side of the reduced-diameter part 3B of the shaft tube 3 as shown in FIG. 5 can be adopted.

Such a grip member cannot be manufactured using the mold explained in the above embodiment because the inner shell does not reach an end face of the grip member. Thus, when a mold where a gate is opened at a molding face for molding an inner face of a grip member is adopted and synthetic resin for forming the inner shell 12 is injected from the gate into the mold, the structure of the mold being somewhat complicated, even a grip member where the inner shell 12 is provided only within the swollen part 13 can be manufactured by injection molding.

Then, the operation and the effect obtained by the above embodiment that the durability of the grip member 10 can be secured while the excellent fit is given to a user can be achieved even by the grip member where the inner shell 12 is provided only within the swollen part 13.

Moreover, the writing implement is not limited to the retractable ballpoint pen, it may be a ballpoint pen provided with a cap, and it may be another kind of writing implement such as a mechanical pencil, a felt pen, and a fountain pen. Thus, the present invention can be applied to any writing implement provided with a shape to be griped by fingers of a user.

The invention claimed is:

1. A writing implement comprising a cylinder-shaped shaft tube, and a cylinder-shaped grip member made of a soft elastic material fitted at a position on the shaft tube where a user can easily grip;

the grip member integrally comprising a cylinder-shaped outer shell provided on an outside of the grip member, and an inner shell made of a material softer than the outer shell and provided inside the outer shell;

the outer shell is formed of a thin part having a thickness that is thin and a thick part having a thickness that is thick;

the inner shell is provided at least on a back side of the thin part inside the outer shell and is in direct contact with the shaft tube;

the inner shell has a thick part formed corresponding to the thin part of the outer shell and having a thickness that is larger than a thickness of a thin part of the inner shell formed corresponding to the thick part of the outer shell;

at least one part of the outer shell is swollen outward to form a swollen part on a surface of the grip member and the surface of the grip member where the swollen part is formed is swollen outward relative to the surface of the grip member where the swollen part is not formed;

the thin part of the outer shell is formed at a part corresponding to the swollen part of the outer shell; and the inner shell is formed inside the thin part of the outer shell corresponding to the swollen part.

2. The writing implement according to claim 1, wherein a part of the inner shell is so formed as to face at least one end face of the grip member.

3. The writing implement according to claim 2, wherein the swollen part inside which the inner shell is provided is formed in the grip member at one of three angular positions approximately trisecting a center angle to a central axis of the shaft tube; and the swollen part inside which the inner shell is provided is not formed at the other angular positions.

4. The writing implement according to claim 1, wherein the combined thickness of the outer shell and the inner shell where the swollen part is formed is larger than the combined thickness of the outer shell and the inner shell where the swollen part is not formed.

* * * * *